US006771177B2

(12) United States Patent
Alderman

(10) Patent No.: US 6,771,177 B2
(45) Date of Patent: Aug. 3, 2004

(54) WARNING DEVICE FOR FOOD STORAGE APPLIANCES

(76) Inventor: David Gene Alderman, 9569 E. Paseo Juan Tabo, Tucson, AZ (US) 85747

( * ) Notice: Subject to any disclaimer, the term of this patent is extended or adjusted under 35 U.S.C. 154(b) by 123 days.

(21) Appl. No.: 10/047,495

(22) Filed: Jan. 14, 2002

(65) Prior Publication Data

US 2003/0132841 A1 Jul. 17, 2003

(51) Int. Cl.[7] ..... G08B 17/00

(52) U.S. Cl. ..... 340/585; 340/588; 340/686.1; 340/521; 340/545.6

(58) Field of Search ..... 340/585, 584, 340/588, 521, 522, 686.1, 545.6; 62/125, 127, 136

(56) References Cited

U.S. PATENT DOCUMENTS 4,490,986 A * 1/1985 Paddock ..... 62/127
4,604,871 A * 8/1986 Chiu et al. ..... 62/136
5,262,758 A * 11/1993 Nam et al. ..... 340/588
5,451,930 A * 9/1995 McDaniel ..... 340/521
5,711,160 A * 1/1998 Namisniak et al. ..... 62/125
5,856,781 A * 1/1999 Michel et al. ..... 340/547
5,917,416 A * 6/1999 Read ..... 340/584
6,060,987 A * 5/2000 Marlia ..... 340/540

* cited by examiner

*Primary Examiner*—Benjamin C. Lee

(57) ABSTRACT

A compact, self-contained, self-powered, autonomous, consumer alarm device within the appliance unit utilizing three visual indicator means and one audible indicator means for providing an indication of normal operation and 4 alarm conditions. The alarm device provides visual and/or audible indications in the event 1) the appliance air temperature is normal; thereby, below the maximum temperature as recommended by the USDA for storage of food, 2) the appliance door is open/ajar for more than five minutes, 3) the appliance air temperature is greater than 40 degrees F., the maximum temperature recommended by the USDA for storage of food, 4) the appliance air temperature has been greater than 40 degrees F. for a period of more than 2 hours, thereby surpassing the USDA guidelines for food which should be consumed by humans, 5) the appliance air temperature has been elevated for "X" amount of time, wherein "X" equals the quantity of hours and 6) battery voltage is low. This device retains the temperature alerts until reset, thereby ensuring that the owner is aware of any divergences from safe storage temperatures. These alerts remain even in the event that the appliance unit returns to normal operation and lowers the temperature down to suitable levels, such as in the case of a temporary power outage. Internal batteries provide power to the device.

6 Claims, 4 Drawing Sheets

Functional Diagram

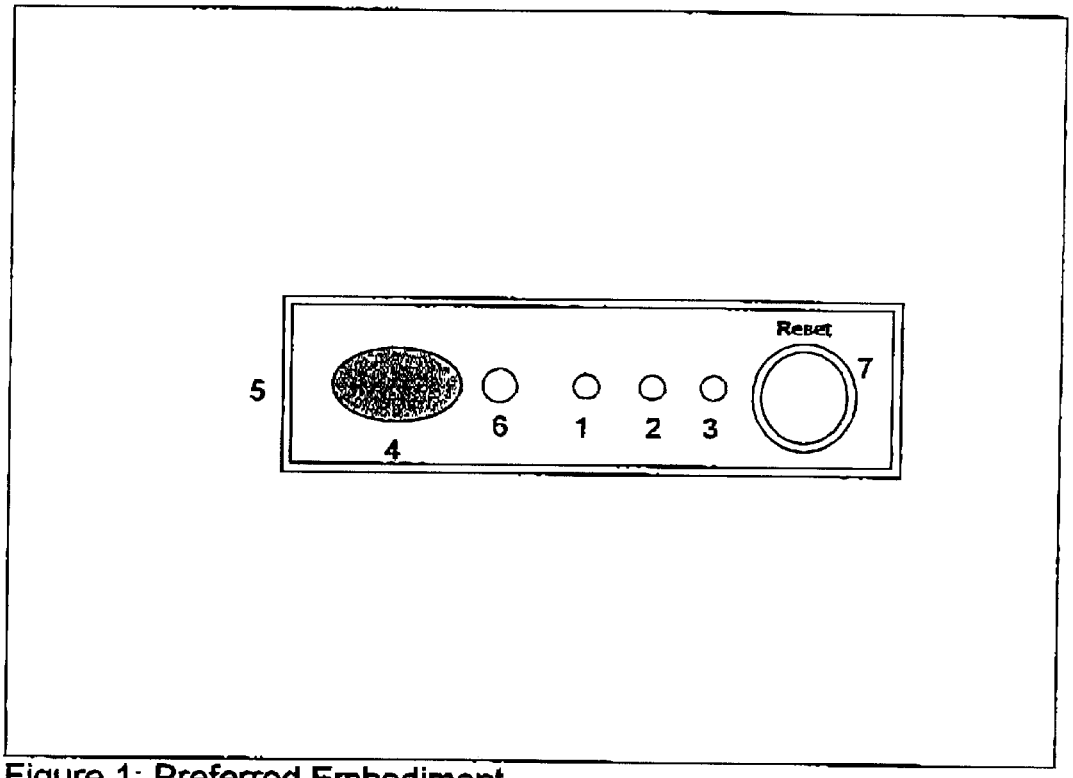
Figure 1: Preferred Embodiment

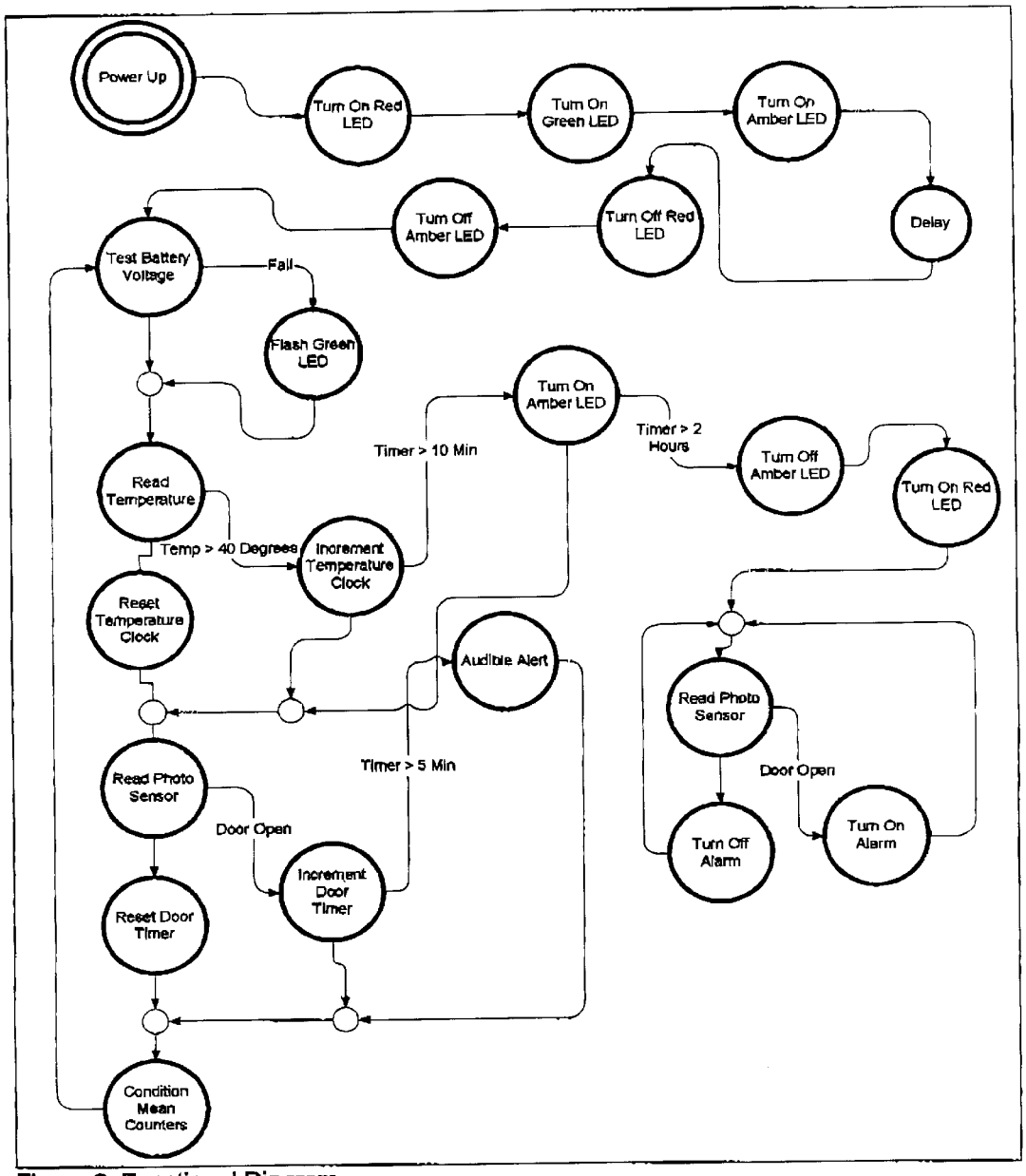
Figure 2: Functional Diagram

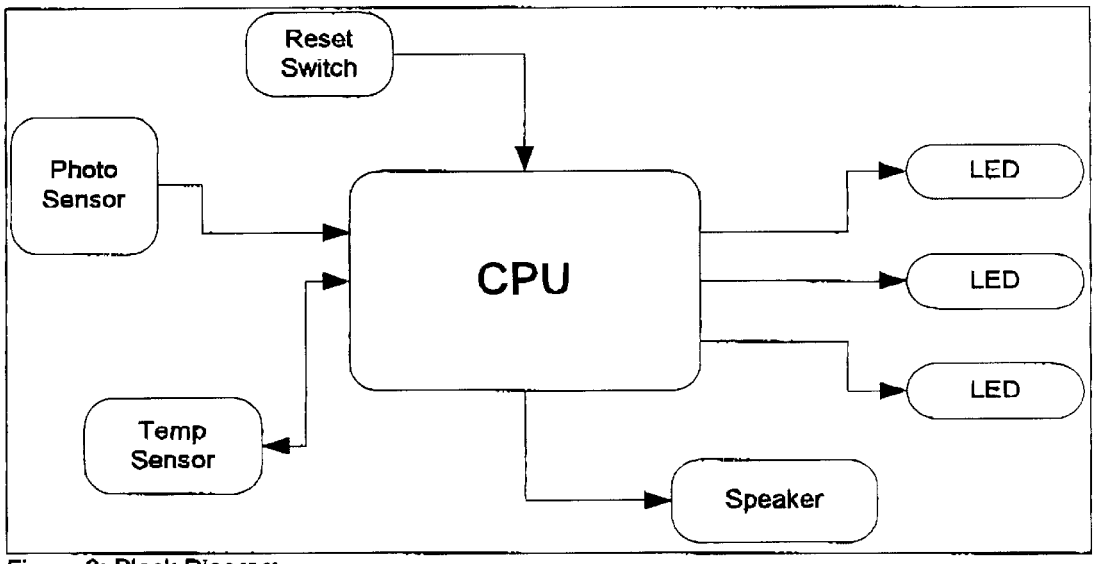
Figure 3: Block Diagram

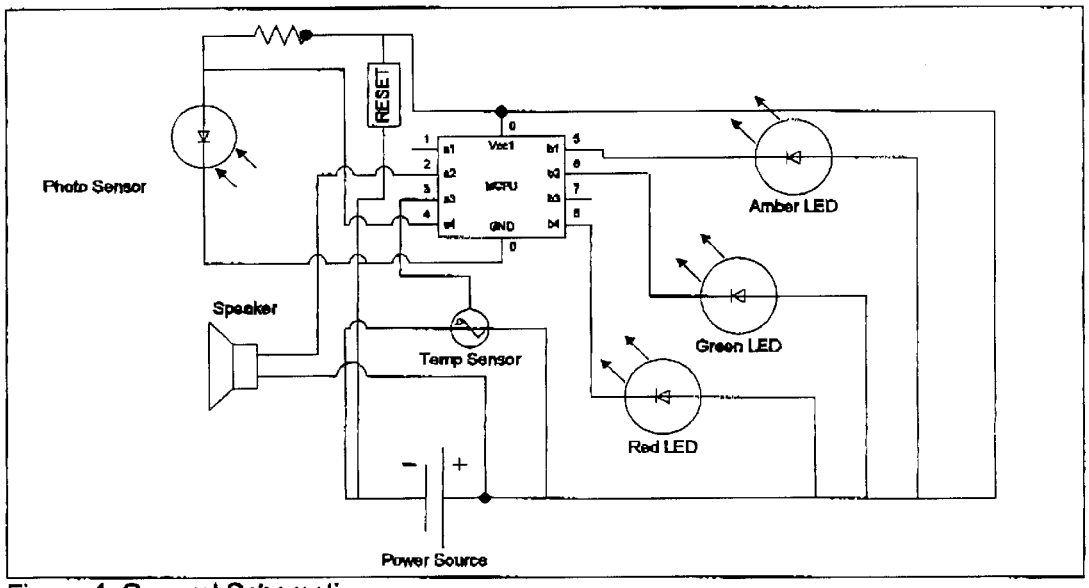
Figure 4: General Schematic

WARNING DEVICE FOR FOOD STORAGE APPLIANCES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1) Field of the Invention

The present invention relates generally to food storage containers such as refrigerators. More specifically, the present invention is a self-contained, self-powered, autonomous device that provides and retains visual and audible indications when 1) the refrigerator temperature is appropriate for food storage, 2) the door is left ajar for a period of time, 3) the refrigerator air temperature rises above the USDA recommended food storage limits, 4) the air temperature in the refrigerator has been greater than the USDA recommended food storage limits for an extended period of time, (5) an indication as to the length of time the refrigerator has exceeded recommended food storage temperatures.

2) Description of Prior Art

This invention provides a self-contained, time-based temperature-monitoring device for refrigerators/food storage containers and an integral door open/ajar alarm. Several patents have been issued for inventions in this classification. The one aspect that each invention lacks is the factor of time of exposure. The United States Department of Agriculture (USDA) publishes recommended guidelines for refrigeration and the safe storage of foods. It is the intent of the present invention to provide visual and audible alarm indicator means in accordance with the recommendations set forth by the USDA.

The Food Safety and Inspection Service (FSIS) of the USDA provides consumer information for refrigeration and food storage via their web site at www.fsis.usda.gov. Their information and data that form the basis for this invention are enumerated below and may be found at the aforementioned site.

Bacteria in refrigerated foods are categorized in two (2) families by the FSIS. These families are pathogenic bacteria, those causing foodborne illnesses (i.e. *e coli*, salmonella, etc.) and spoilage bacteria, which cause food to deteriorate thereby causing the food to discolor, emanate an unpleasant odor, etc.

Pathogenic bacteria do not generally affect the taste, smell, or appearance of a food and present no distinguishable characteristics of its existence to the average consumer. Additionally, pathogenic bacteria have been demonstrated to grow rapidly in the "Danger Zone," temperatures between forty (40) degrees Fahrenheit (F) and one hundred forty (140) degrees F. A spoilage bacterium, on the other hand, results in changes that are perceptible to the unaided senses of the average consumer.

An equally important variable in the equation of food storage safety other than temperature is time. The FSIS has identified that food exposed to temperatures of greater than forty (40) ° F. for a period of more than two (2) hours should not be consumed. The following excerpt is published by the FSIS on their web site:

> For safety, it is important to verify the temperature of the refrigerator. Refrigerators should be set to maintain a temperature of 40° F. or below. An appliance thermometer can be kept in the refrigerator to monitor the temperature. This can be critical in the event of a power outage. When the power goes back on, if the refrigerator is still 40° F., the food is safe. Foods held at temperatures above 40° F. for more than 2 hours should not be consumed.

In each of the patents cited, the inventions failed to provide alarm indicator means based upon the length of time the food was exposed to the elevated temperatures.

The present device offers great advantages over current products available to the average consumer. The installation of the unit will be nothing more than cleaning an area on the flat surface on the appliance liner. After exposing the adhesive on the Velcro strips, the installer simply presses the unit to the liner. Ease of interpretation of the visual alarms and audible alarm make it easily understandable to everyone. Perhaps the most valuable advantage of the device is that it retains the alerts until the unit is reset. In the event of a power outage when the appliance is unattended, the present invention shall detect and provide alerts to the appropriate levels, and then maintain these alerts, even in the event that the power is restored and the appliance returns the temperatures to a suitable level.

Typically, the systems now available that provides a means of detecting temperature increases in refrigerators or food storage devices are elaborate. These elaborate systems require significant costs in the purchase, installation, and maintenance of the system. As in the case of the invention cited in U.S. Pat. No. 4,028,688: Refrigeration unit air temperature detection alarm system (1977). This invention consists of a compact alarm system providing remote indications via a communications device in the event the refrigeration unit rises above a predetermined level. This patent requires a Radio Frequency (RF) link, which, upon a predetermined length of time following the temperature rise, issues an alert using telephony. This invention requires a temperature sensing device, sophisticated circuitry to issue an alert, a RF transmitter, a RF receiver, and circuitry to auto-dial and play a recorded message. This invention requires complicated and costly hardware. Additionally, this invention requires the food storage container, or a portion thereof, be permeable to RF at an undetermined frequency, thereby allowing the RF to transmit through the storage device. Since this invention requires electrical power it will not issue alerts in the event external power is interrupted.

Certain existing inventions, because of their complexity, can only be installed during the manufacture of the appliance. As in U.S. Pat. No. 5,460,006: Monitoring system for food storage device (1995), the invention consists of an internal temperature sensing device which provides a control signal to the refrigeration unit thereby providing automatic, real-time feedback allowing for temperature control. This invention requires extensive electrical modification to an existing food storage device, or installation during manufacturing, to ensure appropriate interface between the invention and the cooling unit. As this invention consists of automatic control, it fails to incorporate alerts in 1) the event of increased temperatures and/or 2) the length of duration of food exposure to increased temperatures.

U.S. Pat. No. 5,451,930: Emergency condition, door ajar, and temperature alarm for appliances provides for an invention with a variety of visual and audible alerts. This invention, based upon its alert for an internal occupant, is aimed primarily at commercial units large enough for entry into the storage area. This invention requires mechanical modification to provide for mounting of a switch to alert for an open door. Since the alert is issued externally to the storage compartment, communications via 1) a RF signal and/or 2) a wired system requires additional equipment and modification to the storage compartment. This invention provides for real-time alerts to temperature increases; however, it requires constant monitoring as there are no apparent means of maintaining alerts when the event is not occurring. This invention does not provide an indication to the length of time that the food was exposed to elevated temperatures. Additionally, this invention does not include an autonomous power supply, hence, whenever electrical power is not provided, the alerts will not be issued. Yet another drawback to the existing invention is that the time is set as a prerogative of the operator. This option allows the operator the possibility of setting the control circuitry to a point where the invention issues an alert beyond safe limits.

A number of patents have been issued for inventions that provide alerts when refrigerator, or food storage device, has been left open for a predetermined length of time. U.S. Pat. Nos. 4,528,558, 4,566,285, 4,691,195, 4,707,684, 4,891,626, and 4,894,643 all provide alerts for open containers. The inventions require modification to the refrigerator by installing additional hardware, switches, etc. Additionally, these inventions all do not provide alerts issued for elevated temperatures and length of time of exposure to such temperatures.

BRIEF SUMMARY OF THE INVENTION

It is, therefore, an object of the present invention to provide the combination of a refrigerator-type, appliance door-ajar alarm system with an appliance air temperature alarm system in a single visual and audible indicator unit. The device shall sense the abnormal condition, provide appropriate alerts, and retain the appropriate alerts until reset.

It is another object of the present invention to provide a means for providing an audible alarm indicator means in the event that the appliance door has been left ajar thereby a) detrimentally affecting the efficiency of the appliance, and b) minimizing the ingression of warm air into the appliance.

It is another object of the present invention to provide a visual indicator means designating that the air temperature in the appliance is less than 40° F., the maximum temperature recommended by the USDA for safe storage of food.

It is another object of the present invention to provide a visual and audible indicator means designating that the air temperature in the appliance is greater than 40° F. for a period of more than five minutes, thereby indicating to the owner of the appliance that the air temperature in the appliance is greater than the safe temperature recommended by the USDA for storage of foods. The visual and audible alarm indicator means may be reset at the prerogative of the owner by actuating the reset switch.

It is another object of the present invention to provide a visual indicator means designating that the air temperature in the appliance is greater than 40° F. for a period of more than two hours, thereby indicating to the owner of the appliance that the stored foods have been exposed to unsafe food storage temperatures for a duration greater than the maximum limit recommended by the USDA. The visual alarm indicator means is reset at the prerogative of the owner by pushing and holding the reset button for a period of ten (10) seconds.

It is another object of the present invention to provide a visual indicator means designating the length of time that the air temperature in the appliance has been greater than 40° F., thereby informing the owner of the appliance of the duration that the stored foods have been exposed to unsafe food storage temperatures.

It is another object of the present invention to provide the visual and audible alarm indicator means in the form of an inexpensive device that can be easily installed by the owner with no modification required of the refrigerator.

It is another object of the present invention to provide the visual and audible alarm indicator means in the form of a device that incorporates an internal supply of power wherein, issued alerts are retained until device is reset by a deliberate action.

DRAWING FIGURES

FIG. 1 is an illustration of the front/top view of the invention.

FIG. 2 is a functional diagram.

FIG. 3 is a block diagram.

FIG. 4 is a general schematic.

| Reference Numerals in Drawings | |
|---|---|
| 1 | Green Annunciator |
| 2 | Amber Annunciator |
| 3 | Red Annunciator |
| 4 | Aural Alert |
| 5 | Plastic Enclosure |
| 6 | Optical Sensor |
| 7 | Reset Switch |

DESCRIPTION—FIG. 1—PREFERRED EMBODIMENT

A preferred embodiment of the invention is illustrated in FIG. 1. The enclosure is a plastic box (6) that can be easily removed, cleaned, and reinstalled in the refrigerator. The front of the unit consists of three visual alarm means (1), (2), & (3), an optical sensor (6), and a reset switch (8) as illustrated in FIG. 1. The battery access is on the back of the device.

The functional diagram of the invention is illustrated in FIG. 2 and details the logic steps performed by the invention during start-up, operationally during temperature monitoring, and during alert modes.

The schematic and diagrams are illustrated in FIGS. 3 and 4. These explain the general functional behavior of the invention. The CPU will maintain all the states of the device other than the reset capability. The reset function will be independent of the state chart described below. It therefore can be implied that the reset function is capable of interrupting the state chart at any point within state structure.

Operation

The present invention provides superior protection by 1) issuing an audible alert in the event the appliance door is left open/ajar, 2) providing a visual indication that the air temperature of the refrigerator is within the safe temperature ranges recommended by the USDA, 3) giving a visual indication and audible alert that the air temperature of the refrigerator is greater than that recommended by the USDA, and 4) providing an alert that the food was exposed to unsafe temperatures for a period greater than the limits recommended by the USDA, and the length of the given duration.

Initial installation of the invention in a refrigerator is to clean the surface where the unit will be installed. Upon ensuring the surface area is dry, remove the protective sheets from the Velcro© tabs (7). Gently press the unit against the interior wall of the refrigerator. It is best to mount the unit high in the refrigerator where it is in clear view. Once the unit is mounted, depress the Reset switch (8) on the front of the enclosure. Depressing the Reset switch will initiate a BIT to ensure all internal monitoring circuitry is functional and verify battery strength.

The integral door alarm provides an audible alert in the event that the refrigerator door is left ajar. The unit determines a door-ajar condition by 1) sensing light via the optical sensor and 2) sensing an increase in air temperature. When these conditions are met the unit initiates a three (3) minute timer sequence prior to issuing the audible tone indicating the refrigerator door is open/ajar.

The first step of the present invention is to measure the air temperature. The measurement medium is a thermal-sensitive device which varies its output based upon temperature (other temperature measuring devices may be used). In the event the air temperature is below 40° F., the microprocessor shall output a signal to a device to illuminate the green annunciator (1) thereby giving indication that the air temperature is within the safe temperatures as defined by the USDA. In the event the air temperature is determined to be greater than 40° F. for three (3) minutes, the microprocessor shall output a signal to a device to illuminate the amber annunciator (2) and temporarily sound the audible alert for a 5-minute period. These annunciations indicate that the temperature of the appliance is greater than that recommended by the USDA. The microprocessor initiates another timing period, which occurs simultaneously with the illumination of the amber annunciator (2), that is set to one hour and fifty-seven minutes. Should the temperature remain above 40° F. and the one hour and fifty-seven minute period expires, the microprocessor turns off the amber annunciator (2) and outputs a signal to a device to illuminate the red annunciator (3). Once the red annunciator illuminates, the microprocessor shall initiate a timing sequence to determine the length of time the air temperature is above safe food storage temperatures. The microprocessor shall output a signal to illuminate the red annunciator a period of 500 millisecond duration in rapid succession where the quantity of illuminations equals the quantity of hours recorded by the microprocessor above 40° F. The time indication will be distinguished by the red annunciator being turned off for a period of three (3) seconds.

The device has an integral door-ajar alert. The alert, an audible tone is set by the occurrence of two events. These events are 1) an increase in temperature, and 2) the sensing of light by the optical sensor. When these conditions are met, the microprocessor delays three (3) minutes prior to sounding the audible tone. The door-ajar alert does not have an associated visual alert.

Upon the issuance of either the amber or red alerts, the device shall remain in said alert state until the device is manually reset. The means to reset the device following the amber alert is to depress the reset switch (8). The means to reset the device following the red alert is to depress and hold the reset switch (8) for 10 seconds.

The final alert mode is set by the device circuitry determining that the internal power supply is weak. Upon reaching a predetermined voltage, the microprocessor outputs a signal to cause the green annunciator to flash thereby giving the alert.

At times when the present invention is in use, the refrigerator door will be opened for a length of time to facilitate internal cleaning, or removal of stored food. It is likely that the invention will enter into an alert mode. Depression of the Reset switch (8) easily accommodates these events. The Reset switch (8) shall 1) initiate a Built-In-Test and, upon its successful completion, 2) reset both internal clocks to zero time and reinitiate monitoring.

Conclusion, Ramifications, and Scope

Although the description above contains many specificities, these should not be construed as limiting the scope of the invention but as merely providing an illustration of some of the presently preferred embodiments of this invention. For example, the unit enclosure can have other shapes, such as circular, oval, trapezoidal, etc. to accomplish an aesthetically pleasing appearance.

In addition to repackaging the unit in various forms, the invention can be integrated in the manufacturing cycle of the appliance. The appliance door, or internal liner of the appliance, can be designed to incorporate appropriate visual alarm indicator means and audible alarm indicator means. The control circuitry, power source, and reset switch can be installed by the original manufacturer of the appliance.

The electrical circuitry can be accomplished using many various devices in both analog and digital circuits. Components may be altered by engineering design. The means of determining and sensing the air temperature may be accomplished via microchip, dissimilar metals, thermistor, etc.

The means of installing the device into the refrigerator may be through an adhesive strip, magnets, clips, etc.

I claim as my invention:

1. A combination refrigerator/food storage container appliance alarm device for providing alerts that a door of the appliance has been left open/ajar and providing alerts in the events that a) appliance internal air temperature rises over the preset limit of forty (40) degrees F., b) appliance internal air temperature has remained at elevated temperature for the set cumulative time period of two (2) hours, and c) the length of time that elevated temperatures have been detected, comprising:

a first visual indicator (green annunciator) means;

a second visual indicator (amber annunciator) means;

a third visual indicator (red annunciator) means;

an audible indicator means;

an integral reset switch; and, electronic circuitry, said electronic circuitry capable of detecting appliance air temperature and light, and controlling said first indicator means, and said second indicator means, and said third indicator means, and said audible indicator means in response to said events and the door left open/ajar condition.

2. The combination appliance alarm device of claim 1, wherein said electronic control circuitry further comprises:

means for illuminating said first visual indicator means;

wherein, said first visual indicator means is illuminated by said electronic circuitry by appliance internal air temperature equal to, or less than said preset limit of forty (40) degrees F.

3. The combination appliance alarm device of claim 1, wherein said electronic control circuitry further comprises:

means of illuminating said second visual indicator means;

means for triggering said audible indicator means;

wherein, said second visual indicator means is illuminated and said audible indicator means is triggered by said electronic circuitry by appliance internal air temperature of more than said preset limit of forty (40) degrees F. over a time delay said second visual indicator means may only be reset by actuation of said integral reset switch.

4. The combination appliance alarm device of claim 1, wherein said electronic control circuitry further comprises:

means of illuminating said third visual indicator means;

wherein, said third visual indicator means are illuminated by said electronic circuitry by appliance internal air temperature of more than said preset limit of forty (40) degrees F. for a length of time greater than said cumulative time period of two (2) hours said third visual indicator means may only be reset by actuation of said reset.

5. The combination appliance alarm device of claim 1, wherein said electronic control circuitry further comprises:

means of illuminating said third visual indicator means;

wherein, said third visual indicator means repeatedly flashes in rapid succession equal to the number of hours corresponding to said length of time, and may only be reset by actuation of said reset switch.

6. The combination appliance alarm device of claim 1, wherein said electronic control circuitry further comprises:

means for triggering said audible indicator means;

wherein, said audible indicator means are triggered by said electronic circuitry by a) an alert condition has been determined and the optical sensor detects light, b) the optical sensor detects light beyond the period determined by the algorithm where Door Open Alert Limit=(Total Time the Door is Open/Door Open Events)+10 seconds. The Door Open Alert maximum limit is ninety (90) seconds.

* * * * *